US007452459B2

(12) United States Patent
Schultz et al.

(10) Patent No.: US 7,452,459 B2
(45) Date of Patent: Nov. 18, 2008

(54) PROCESS FOR THE REMOVAL OF SULFUR-OXIDATED COMPOUNDS FROM A HYDROCARBONACEOUS STREAM

(75) Inventors: Michael A. Schultz, Chicago, IL (US); John P. Brady, Algonquin, IL (US)

(73) Assignee: UOP LLC, Des Plaines, IL (US)

( * ) Notice: Subject to any disclaimer, the term of this patent is extended or adjusted under 35 U.S.C. 154(b) by 417 days.

(21) Appl. No.: 10/813,250

(22) Filed: Mar. 30, 2004

(65) Prior Publication Data

US 2005/0218040 A1 Oct. 6, 2005

(51) Int. Cl.
*C10G 25/00* (2006.01)
*C10G 25/12* (2006.01)

(52) U.S. Cl. ..... 208/250; 208/305

(58) Field of Classification Search ..... 208/213, 208/305, 299, 245, 250, 208 R, 177, 189; 585/820, 826

See application file for complete search history.

(56) References Cited

U.S. PATENT DOCUMENTS 4,354,929 A * 10/1982 Wessels et al. ..... 208/310 Z
5,755,933 A * 5/1998 Ognisty et al. ..... 202/158
6,019,887 A * 2/2000 Ramirez de Agudelo et al. . 208/254 R
6,277,271 B1 8/2001 Kocal ..... 208/212
6,395,950 B1 * 5/2002 Rice ..... 585/738
6,482,316 B1 * 11/2002 Bal ..... 208/299
6,875,410 B2 * 4/2005 Satokawa et al. ..... 423/244.1
2002/0009404 A1 * 1/2002 Tsybulevskiy et al. . 423/244.04

* cited by examiner

*Primary Examiner*—Glenn Caldarola
*Assistant Examiner*—Randy Boyer
(74) *Attorney, Agent, or Firm*—James C Paschall

(57) ABSTRACT

A process for the removal of sulfur-oxidated compounds from a hydrocarbonaceous stream containing sulfur-oxidated compounds wherein the hydrocarbonaceous stream containing sulfur-oxidated compounds is contacted with an adsorbent which selectively adsorbs sulfur-oxidated compounds from the hydrocarbonaceous stream to produce an adsorbent having adsorbed sulfur-oxidated compounds. The loaded adsorbent containing sulfur-oxidated compounds is contacted with a desorbent to produce a desorbent containing sulfur-oxidated compounds and an adsorbent having a reduced content of sulfur-oxidated compounds. The regenerated adsorbent is then used to remove additional sulfur-oxidated compounds.

11 Claims, 1 Drawing Sheet

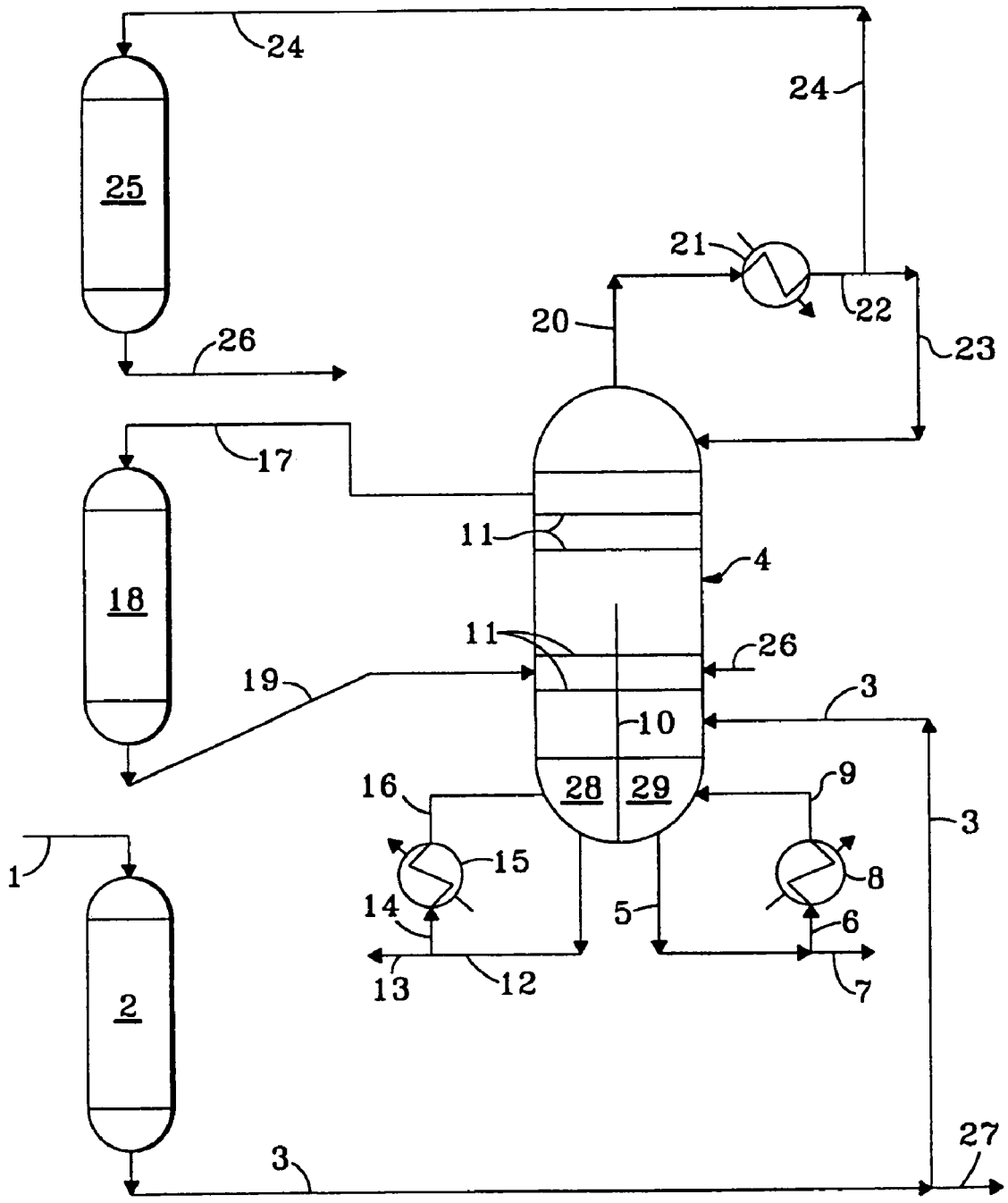
24
24
25
21
22
20
23
26
17
18
11
4
11
26
19
3
10
16
28
29
9
3
1
15
8
14
5
6
13
12
7
2
27
3

PROCESS FOR THE REMOVAL OF SULFUR-OXIDATED COMPOUNDS FROM A HYDROCARBONACEOUS STREAM

FIELD OF THE INVENTION

The field of art to which this invention pertains is the removal of sulfur oxidated compounds from a hydrocarbonaceous stream.

BACKGROUND OF THE INVENTION

There is an increasing demand to reduce the sulfur content of hydrocarbonaceous oil to produce products which have very low concentrations of sulfur and are thereby marketable in the ever more demanding marketplace. With the increased environmental emphasis on the requirement for more environmentally friendly transportation fuels, those skilled in the art have sought to find feasible and economical techniques to reduce the sulfur content of hydrocarbonaceous oil to low concentrations.

Traditionally, hydrocarbons containing sulfur have been subjected to a catalytic hydrogenation zone to remove sulfur and produce hydrocarbons having lower concentrations of sulfur. Hydrogenation to remove sulfur is very successful for the removal of the sulfur from hydrocarbons that have sulfur components that are easily accessible to contact with the hydrogenation catalyst. However, the removal of sulfur components which are sterically hindered becomes exceedingly difficult and therefore the removal of sulfur components to a sulfur level below about 100 ppm is very costly by known current hydrotreating techniques. It is also known that a hydrocarbonaceous oil containing sulfur may be subjected to oxygenation to convert the hydrocarbonaceous sulfur compounds to compounds containing sulfur and oxygen, such as sulfoxide or sulfone for example, which have different chemical and physical characteristics.

Although the contrasting characteristics of hydrocarbons and the sulfoxides or sulfones would suggest the separation of the sulfur-oxidated compounds, there is a continuing need for a process to successfully isolate the sulfur-isolated compounds while maximizing the yield of sulfur-free hydrocarbons in a facile and economical manner. Fractionation of diesel boiling range hydrocarbons to isolate and recover sulfur-oxidated compounds is not possible because the sulfur-oxidated compounds boil within the same range as some of the diesel fraction. Adsorbents have a relatively low capacity on a weight basis and when large quantities of hydrocarbon feedstocks containing sulfur-oxidated compounds are to be separated, simple adsorption is not economically feasible.

Information Disclosure

U.S. Pat. No. 6,277,271 B1 (Kocal) discloses a process for the desulfurization of a hydrocarbonaceous oil wherein the hydrocarbonaceous oil and a recycle stream containing sulfur-oxidated compounds is contacted with a hydrodesulfurization catalyst in a hydrodesulfurization reaction zone to reduce the sulfur level to a relatively low level and then contacting the resulting hydrocarbonaceous stream from the hydrodesulfurization zone with an oxidizing agent to convert the residual, low level of sulfur compounds into sulfur-oxidated compounds and the resulting hydrocarbonaceous oil stream containing the sulfur-oxidated compounds is separated to produce a stream containing the sulfur-oxidated compounds and a hydrocarbonaceous oil stream having a reduced concentration of sulfur-oxidated compounds. At least a portion of the sulfur-oxidated compounds is recycled to the hydrodesulfurization reaction zone.

BRIEF SUMMARY OF THE INVENTION

The present invention provides a process for the removal of sulfur-oxidated compounds from a hydrocarbonaceous stream containing sulfur-oxidated compounds wherein the hydrocarbonaceous stream containing sulfur-oxidated compounds is contacted with an adsorbent which selectively adsorbs sulfur-oxidated compounds from the hydrocarbonaceous stream to produce an adsorbent having adsorbed sulfur-oxidated compounds. The loaded adsorbent containing sulfur-oxidated compounds is contacted with a desorbent to produce a desorbent containing sulfur-oxidated compounds and an adsorbent having a reduced content of sulfur-oxidated compounds. The regenerated adsorbent is then recycled to remove additional sulfur-oxidated compounds. The desorbent containing sulfur-oxidated compounds is fractionated to recover a desorbent having a reduced concentration of sulfur-oxidated compounds.

In a preferred embodiment of the present invention, the interstitial hydrocarbonaceous compounds are purged with a liquid purge stream before the desorbent is contacted with the sulfur-oxidated compound laden adsorbent. In another preferred embodiment of the present invention, when both a purge stream and a desorbent stream are employed, these streams are preferably recovered in a split shell fractionation zone.

Other embodiments of the present invention encompass further details such as feedstocks, adsorbents, desorbents, purge components and operating conditions, all of which are hereinafter disclosed in the following discussion of each of these facets of the invention.

BRIEF DESCRIPTION OF THE DRAWING

The drawing is a simplified schematic process flow diagram of a preferred embodiment of the present invention.

DETAILED DESCRIPTION OF THE INVENTION

The present invention provides an improved method for the removal of sulfur-oxidated compounds from a hydrocarbonaceous feedstock containing sulfur-oxidated compounds. In accordance with the present invention, a preferred hydrocarbonaceous feedstock containing sulfur-oxidated compounds contains distillable hydrocarbons boiling in the range from 149° C. (300° F.) to about 538° C. (1000° F.). A preferred embodiment is to produce diesel boiling range hydrocarbon streams containing less than about 50 ppm sulfur. The hydrocarbonaceous feedstock may be produced by any known method. In one known method to desulfurize diesel boiling range hydrocarbons, the hydrocarbonaceous oil containing sulfur may be subjected to oxygenation to convert the hydrocarbonaceous sulfur compounds to sulfur-oxidated compounds and thereby provide at least one potential feedstock for the present invention. The sulfur-oxidated compounds are preferably present in the hydrocarbonaceous feedstock in an amount less than about 0.7 weight percent and more preferably less than about 0.6 weight percent. The resultant treated hydrocarbonaceous product preferably contains less than about 0.035 weight percent and more preferably less than 0.015 weight percent sulfur-oxidated compounds. The sulfur-oxidated compounds are preferably selected from the group consisting of sulfoxides and sulfones. Since the sulfur-oxidated compounds contain only a small weight fraction of sulfur, the resultant treated hydrocarbonaceous products preferably contain less than about 50 wppm and more preferably less than about 20 wppm sulfur.

The hydrocarbonaceous feedstock containing sulfur-oxidated compounds is contacted with an adsorbent which selectively adsorbs sulfur-oxidated compounds to produce an adsorbent having adsorbed sulfur-oxidated compounds. Any suitable adsorbent maybe utilized in the process of the present invention. Preferred adsorbents include activated charcoal, hydrotalcite, ion exchange resin, zeolites, silica-alumina and silica gel. The contacting of the hydrocarbonaceous feedstock with the adsorbent is preferably conducted at conditions which include a temperature from about 25° C. (77° F.) to about 125° C. (257° F.), a pressure from about 1240 kPa (165 psig) to about 1825 kPa (250 psig) and a liquid hourly space velocity from about 5 $hr^{-1}$ to about 50 $hr^{-1}$. Although the contacting with the adsorbent may be conducted in any convenient manner, the adsorbent is preferably installed in a fixed bed and may then be contacted in an upflow, downflow or radial flow fashion. When the resulting adsorbent begins to lose its ability to adsorb sulfur-oxidated compounds, it is considered to be spent and in need of regeneration. Spent adsorbent preferably contains from about 0.2 to about 2 weight percent sulfur-oxidated compounds. In a preferred embodiment, the adsorbent is contained in three or more beds with at least two beds being simultaneously operated in series and at least one bed being regenerated by solvent desorption.

In a preferred embodiment of the present invention, the spent adsorbent is contacted with a suitable desorbent to recover the sulfur-oxidated compounds and thereby regenerate the adsorbent. Any suitable desorbent may be used in accordance with the present invention. Preferred desorbents may be selected from pentane, hexane, benzene, toluene, xylene and mixtures thereof. The desorbent is preferably contacted with the spent adsorbent at a temperature in the range from about 43° C. (110° F.) to about 125° C. (257° F.) and a pressure to maintain the desorbent in the liquid phase. The desorbent is contacted with the adsorbent for a sufficient amount of time to remove at least a majority of the adsorbed sulfur-oxidated compounds. After regeneration, the adsorbent is then returned to service and contacted with a hydrocarbonaceous stream containing sulfur-oxidated compounds. The resulting desorbent containing desorbed sulfur-oxidated compounds is fractionated to produce a stream containing sulfur-oxidated compounds and a stream containing desorbent and having a reduced concentration of sulfur-oxidated compounds. The resulting regenerated desorbent stream is then preferably recycled for subsequent regenerations.

In another preferred embodiment of the present invention, before the spent adsorbent is contacted with the desorbent, the adsorbent bed containing interstitial hydrocarbons having a reduced concentration of sulfur-oxidated compounds is flushed or purged with a purge stream to recover valuable hydrocarbons. The resulting purge stream containing hydrocarbons having a reduced concentration of sulfur-oxidated compounds is fractionated to produce a stream containing hydrocarbons having a reduced concentration of sulfur-oxidated compounds and a regenerated purge stream which may then be recycled. The purge stream may be any suitable liquid which effectively flushes or purges the void space in an adsorbent bed. The purge stream preferably is selected from pentane, hexane or admixtures thereof. It is also preferred that the purge stream boils in a range lower than the boiling range of the desorbent.

In the case when the desorbent regeneration is conducted with a purge step followed by a desorption step, the fractionation of the two separately generated steams may be fractionated in a single split shell fractionation zone to produce a regenerated purge stream, a regenerated desorbent stream, a stream containing sulfur-oxidated compounds and a stream containing hydrocarbons having a reduced concentration of sulfur-oxidated compounds.

A split shell fractionation zone is a fractionator which has a vertical dividing wall placed in the lower end of the fractionation zone and sealed between the wall and the outer shell to provide two separate spaces. The two spaces are each capable of containing a separate liquid which possesses different concentrations of components. The dividing wall extends upwardly from the bottom and ends part way up the height of the fractionator. The fractionator contains fractionation means, such as trays, plates or packing, for example. Each of the two spaces or compartments is open and communicates with the upper end of the fractionation zone. Each space is independently reboiled to maintain the desired isolation.

In accordance with a preferred embodiment which utilizes a purge step prior to the desorbent step and the purge liquid boils in a temperature range lower than the boiling temperature range of the desorbent, a bed of spent adsorbent containing sulfur oxidative compounds is contacted with a purge stream to flush low sulfur liquid hydrocarbon and the resulting effluent is introduced into the low sulfur compartment of the split shell fractionation zone. Following the purge stream, a liquid desorbent stream is introduced into the bed of spent adsorbent to desorb sulfur oxidated compounds and the resulting effluent is introduced into the high sulfur compartment of the split shell fractionation zone.

The split shell fractionation zone is separately reboiled in both the low sulfur compartment and the high sulfur compartment, and is refluxed in a conventional manner. The purge component is flashed from the bottoms liquid held in the low sulfur compartment and is withdrawn as a liquid from an upper location in the fractionation zone. The desorbent component is flashed from the bottom liquid held in the high sulfur compartment and is withdrawn as a liquid from an upper location in the fractionation zone. The liquid purge stream draw point is located above the liquid desorbent stream draw point in the fractionation zone. A net liquid stream containing a low concentration of sulfur-oxidated compounds is removed from the low sulfur compartment and a net liquid stream containing a higher concentration of sulfur-oxidated compounds is removed from the high sulfur compartment. The recovered purge stream and desorbent steam may then be recycled to regenerate a newly spent adsorbent zone.

DETAILED DESCRIPTION OF THE DRAWING

In the drawing, the process of the present invention is illustrated by means of a simplified schematic flow diagram in which such details as pumps, instrumentation, heat exchange and heat recovery circuits, compressors and similar hardware have been deleted as being non-essential to an understanding of the techniques involved. The use of such miscellaneous equipment is well within the purview of one skilled in the art.

Although the invention is exemplified in the drawing using three separate adsorption zones, the process of the invention may be practiced while using a single adsorption zone although not necessarily with all the same advantages.

Three adsorption zones identified as adsorption zones 2, 18 and 25 are normally operated with a lead adsorption zone, a lag adsorption zone in series with the lead adsorption zone and one adsorption zone either undergoing regeneration or on standby. In an effort to demonstrate the invention without showing detailed manifolding and valving which are readily understood by those skilled in the art, the drawing depicts a snapshot of when adsorption zone 25 is undergoing a purge step to remove low sulfur compounds, when adsorption zone 18 is undergoing a desorption step to remove adsorbed sulfur-oxidated compounds and when adsorption zone 2 is producing a product stream containing low sulfur compounds.

A diesel boiling range hydrocarbon stream containing sulfur oxidated compounds is introduced into the process via line 1 and is introduced into adsorption zone 2. A resulting diesel boiling range hydrocarbon stream containing a reduced concentration of sulfur oxidized compounds is removed from adsorption zone 2 via line 3 and an initial portion of this effluent is transported via line 3 and introduced into low sulfur, lower end zone 29 contained in split shell fractionation zone 4 to remove and recover desorbent from a previous regeneration. After the initial flow has been completed by removing sufficient desorbent from a previous regeneration of adsorption zone 2, the diesel boiling range hydrocarbon stream containing a reduced concentration of sulfur oxidated compounds is transported via line 3 and 27 and recovered as a low sulfur product. A purge stream containing a purge liquid and transported via line 24 is introduced into adsorption zone 25 which contains adsorbent which is spent and contains sulfur oxidated compounds. The purge stream sweeps the diesel boiling range hydrocarbons having a reduced concentration of sulfur oxidated compounds from the void spaces surrounding the spent adsorbent and the resulting admixture of the purge liquid and the diesel boiling range hydrocarbons is removed from absorption zone 25 via line 26 and introduced into low sulfur, lower end zone 29 contained in split shell fractionation zone 4. A desorbent liquid is carried via line 17 and introduced into adsorption zone 18 which contains spent absorbent containing sulfur oxidized compounds. An admixture of desorbent and sulfur oxidized compounds is removed from adsorption zone 18 via line 19 and introduced into high sulfur, lower end zone 28 of split shell fractionation zone 4. A liquid stream containing diesel boiling range hydrocarbons and a high concentration of sulfur oxidated compounds is removed from high sulfur, lower end zone 28 via line 12 and a portion is removed and recovered via lines 12 and 13 and another portion is carried via lines 12 and 14 and introduced into heat-exchanger 15. A resulting heated effluent stream containing liquid and vapor is removed from heat-exchanger 15 via line 16 and introduced into high sulfur, lower end zone 28. A liquid hydrocarbonaceous stream containing diesel boiling range hydrocarbons having a low level of sulfur oxidated compounds is removed from low sulfur, lower end zone 29 via line 5 and at least a portion thereof is recovered via line 7 and another portion is transported via lines 5 and 6 and introduced into heat-exchanger 8. A resulting heated effluent stream containing vapor and liquid is removed from heat-exchanger 8 via line 9 and introduced into low sulfur, lower end zone 29 of split shell fractionation zone 4. The bottom end of split shell fractionation zone 4 is divided into two compartments by partition 10. A number of fractionation trays are employed in the split shell fractionation zone 4 and are schematically represented by trays 11. A liquid desorbent stream is removed from split shell fractionation zone 4 via line 17 and is introduced into absorption zone 18 as hereinabove described. A vapor stream containing purge material is removed from split shell fractionation zone 4 via line 20 and introduced into heat-exchanger 21. A resulting condensed liquid containing purge material is removed from heat-exchanger 21 via line 22 and a portion is carried via line 23 and introduced into split shell fractionation zone 4 as reflux and another portion is carried via line 24 and introduced into adsorption zone 25 as described hereinabove.

When adsorption zone 2 becomes spent, the fresh feed flow to adsorption zone 2 is replaced by a purge stream, the desorbent to adsorption zone 18 is replaced by a fresh feed flow and the purge stream to adsorption zone 25 is replaced by a desorbent stream.

When adsorption zone 18 becomes spent, the fresh feed flow to adsorption zone 18 is replaced by a purge stream, the desorbent to adsorption zone 25 is replaced by a fresh feed flow and the purge stream to adsorption zone 2 is replaced by a desorbent stream.

When adsorption zone 25 becomes spent, the fresh feed to adsorption zone 25 is replaced by a purge stream, the desorbent to adsorption zone 2 is replaced by a fresh feed flow and the purge stream to adsorption zone 18 is replaced by a desorbent stream.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A fresh feed stream of diesel boiling range hydrocarbons containing sulfur-oxidated compounds including 145 wppm sulfur is introduced into a newly regenerated adsorbent zone, which contains particulate adsorbent and liquid desorbent from a previous regeneration step, at a rate of 1167 $m^3$/hr. This flow rate is maintained for about five minutes and the effluent during this time is introduced into a low-sulfur bottom-end of a split shell fractionation zone. After the five minutes elapses and the liquid desorbent is flushed from the regenerated adsorbent zone, the effluent is then collected in a separate product storage tank and contains less than about 10 wppm of sulfur.

When the operating adsorbent zone becomes sufficiently loaded with sulfur-oxidated compounds and starts to adversely impact the sulfur level in the effluent product, the fresh feed stream is replaced by a purge stream containing hexane which flows at a rate of 256 $m^3$/hr. for about 16 minutes to recover interstitial diesel boiling range hydrocarbons having a low sulfur concentration (less than about 10 wppm of sulfur) and is introduced into a low-sulfur bottom-end zone of a split shell fractionation zone. After the 16 minutes have elapsed, the purge stream is replaced by a desorbent stream which flows at a rate of 256 $m^3$/hr. for about 40 minutes to desorb sulfur-oxidated compounds, thereby regenerating the adsorbent. The desorbent and desorbed sulfur-oxidated compounds mixture is introduced into the high-sulfur bottom-end zone of the fractionation zone. After the desorbent stream is discontinued, the adsorbent zone is deemed regenerated and returned to adsorbent service. The high-sulfur bottom-end zone and the low-sulfur bottom-end zone of the split shell fractionation zone are independently reboiled to vaporize the purge stream components and the desorbent stream components. A resulting liquid purge stream and a resulting liquid desorbent stream are removed from the fractionation zone at separate draw-off trays. A diesel stream containing 16 weight percent sulfur compounds in an amount of 12 $m^3$/hr is removed from the high-sulfur bottom-end zone and discarded. A diesel stream containing less than about 10 wppm sulfur compounds in an amount of 66 $m^3$/hr is removed from the low-sulfur bottom-end zone and directed to the product storage tank. The total amount of low sulfur diesel product recovered was about 1155 $m^3$/hr. and contained less than about 10 wppm sulfur.

The foregoing description, drawing and illustrative embodiment clearly illustrate the advantages encompassed by the process of the present invention and the benefits to be afforded with the use thereof.

What is claimed is:

1. A process for the removal of sulfur-oxidated compounds from a hydrocarbonaceous stream containing sulfur-oxidated compounds wherein the process comprises:

(a) contacting a hydrocarbonaceous stream containing sulfur-oxidated compounds with an adsorbent which selectively adsorbs sulfur-oxidated compounds to produce an adsorbent having adsorbed sulfur-oxidated compounds;

(b) contacting the adsorbent having adsorbed sulfur-oxidated compounds with a desorbent to produce a desorbent containing sulfur-oxidated compounds and an adsorbent having a reduced content of sulfur-oxidated compounds;

(c) introducing desorbent containing sulfur-oxidated compounds from step (b) into a high sulfur, lower end zone of a split shell fractionation column;

(d) contacting the adsorbent from step (b) with a hydrocarbonaceous stream containing sulfur-oxidated compounds;

(e) introducing an initial portion of an effluent from step (c) comprising desorbent from step (b) into a low sulfur, lower end zone of said split shell fractionation column, (f) fractionating the desorbent containing sulfur-oxidated compounds from step (b) to recover a desorbent having a reduced concentration of sulfur-oxidated compounds; and (g) recovering a hydrocarbonaceous stream containing a reduced concentration of sulfur-oxidated compounds.

2. The process of claim 1 wherein the sulfur-oxidated compounds are selected from the group consisting of sulfoxides and sulfones.

3. The process of claim 1 wherein the adsorbent is selected from the group consisting essentially of activated charcoal, hydrotalcite, ion exchange resin, zeolites, silica-alumina, and silica gel.

4. The process of claim 1 wherein the adsorbent having adsorbed sulfur-oxidated compounds contains from about 0.2 to about 2 weight percent sulfur-oxidated compounds.

5. The process of claim 1 wherein the contacting in step (a) is conducted at a temperature from about 25° C. (77° F.) to about 125° C. (257° F.) and a pressure from about 1240 kPa (165 psig) to about 1825 kPa (250 psig).

6. The process of claim 1 wherein the desorbent in step (c) is introduced at a temperature from about 43° C. (110° F.) to about 125° C. (257° F.).

7. The process of claim 1 wherein the desorbent comprises pentane, hexane, benzene, toluene, or xylene.

8. The process of claim 1 wherein the hydrocarbonaceous stream comprises diesel boiling range hydrocarbons.

9. The process of claim 1 wherein the hydrocarbonaceous stream containing sulfur-oxidated compounds boils in the range from about 149° C. (300° F.) to about 538° C. (1000° F.).

10. The process of claim 1 wherein the fractionating in step (d) is conducted in a split shell fractionation zone.

11. The process of claim 1 wherein at least a portion of the desorbent having a reduced concentration of sulfur-oxidated compounds recovered in step (d) is recycled to step (b).

* * * * *